US009539714B1

(12) United States Patent
Pedicini

(10) Patent No.: US 9,539,714 B1
(45) Date of Patent: Jan. 10, 2017

(54) FASTENER DRIVING APPARATUS

(71) Applicant: Christopher Pedicini, Nashville, TN (US)

(72) Inventor: Christopher Pedicini, Nashville, TN (US)

(73) Assignee: Tricord Solutions, Inc., Franklin, TN (US)

( * ) Notice: Subject to any disclaimer, the term of this patent is extended or adjusted under 35 U.S.C. 154(b) by 0 days.

(21) Appl. No.: 15/012,498

(22) Filed: Feb. 1, 2016

Related U.S. Application Data

(63) Continuation-in-part of application No. 14/877,742, filed on Oct. 7, 2015.

(60) Provisional application No. 62/060,690, filed on Oct. 7, 2014, provisional application No. 62/195,850, filed on Jul. 23, 2015.

(51) Int. Cl.
*B25C 1/04* (2006.01)
*B25C 1/06* (2006.01)

(52) U.S. Cl.
CPC ..... *B25C 1/047* (2013.01); *B25C 1/04* (2013.01); *B25C 1/06* (2013.01)

(58) Field of Classification Search
CPC ..... B25C 1/06; B25C 1/04; B25C 1/047; B25C 1/041; B25C 5/13
See application file for complete search history.

(56) References Cited

U.S. PATENT DOCUMENTS

| | | | | |
|---|---|---|---|---|
| 2,887,686 | A * | 5/1959 | Wandel | B25C 1/04 173/112 |
| 3,589,588 | A * | 6/1971 | Vasku | B25C 1/06 227/109 |
| 4,215,808 | A * | 8/1980 | Sollberger | B25C 1/041 173/204 |
| 5,503,319 | A * | 4/1996 | Lai | B25C 5/15 173/203 |
| 5,720,423 | A * | 2/1998 | Kondo | B25C 1/04 227/130 |
| 8,011,441 | B2 * | 9/2011 | Leimbach | B25C 1/047 173/1 |
| 8,079,504 | B1 | 12/2011 | Pedicini et al. | |
| 8,602,282 | B2 | 12/2013 | Leimbach et al. | |
| 8,763,874 | B2 * | 7/2014 | McCardle | B25C 1/047 227/129 |
| 2007/0045377 | A1 * | 3/2007 | Towfighi | B25C 1/06 227/130 |

(Continued)

*Primary Examiner* — Andrew M Tecco
(74) *Attorney, Agent, or Firm* — Jay Schloff; Aidenbaum Schloff and Bloom PLLC

(57) ABSTRACT

A fastener driving apparatus comprises a gas spring or spring, a drive mechanism, an anvil assembly, and an anvil. The drive mechanism permits transition from engagement with the gas spring, spring or anvil assembly to disengagement from the gas spring, spring or anvil assembly. The anvil and/or anvil assembly are operatively coupled to the gas spring or spring such that after the drive mechanism disengages them, the gas spring piston or the spring moves to imparts a force on the anvil to cause the anvil to move and drive a fastener. The mass of the anvil assembly is preferably greater than 50% of the total mass of the anvil assembly and gas spring moving mass. The gas spring is configured such that the pressure increase during the movement of the gas spring piston by the drive mechanism is less than 30% of the initial pressure in the gas spring.

20 Claims, 6 Drawing Sheets

(56) References Cited

U.S. PATENT DOCUMENTS

| | | | | |
|---|---|---|---|---|
| 2012/0325887 | A1 | 12/2012 | Wolf | |
| 2014/0054350 | A1* | 2/2014 | Pedicini | B25C 5/15 227/8 |
| 2016/0096259 | A1* | 4/2016 | Pedicini | B25C 1/047 227/146 |

* cited by examiner

FASTENER DRIVING APPARATUS

CROSS REFERENCE TO RELATED APPLICATIONS

The present disclosure is a continuation-in-part of U.S. Non-provisional patent application Ser. No. 14/877,742, filed on Oct. 7, 2015 and also claims priority under 35 United States Code, Section 119 on the U.S. Provisional patent application Ser. No. 62/060,690 filed on Oct. 7, 2014, and Ser. No. 62/195,850 filed Jul. 23, 2015, the disclosures of which are incorporated by reference.

FIELD OF THE DISCLOSURE

The present disclosure relates to fastener driving apparatuses, and, more particularly, to such fastener or staple driving mechanisms that require operation as a hand tool.

BACKGROUND

Electromechanical fastener driving apparatuses (also referred to herein as a "driver," "gun" or "device") known in the art often weigh generally less than 15 pounds and may be configured for an entirely portable operation. Contractors and homeowners commonly use power-assisted devices and means of driving fasteners into wood. These power-assisted means of driving fasteners can be either in the form of finishing fastener systems used in baseboards or crown molding in house and household projects, or in the form of common fastener systems that are used to make walls or hang sheathing onto same. These systems can be portable (i.e., not connected or tethered to an air compressor or wall outlet) or non-portable.

The most common fastener driving apparatus uses a source of compressed air to actuate a guide assembly to push a fastener into a substrate. For applications in which portability is not required, this is a very functional system and allows rapid delivery of fasteners for quick assembly. A disadvantage is that it does however require that the user purchase an air compressor and associated air-lines in order to use this system. A further disadvantage is the inconvenience of the device being tethered (through an air hose) to an air compressor.

To solve this problem, several types of portable fastener drivers operate off of fuel cells. Typically, these guns have a guide assembly in which a fuel is introduced along with oxygen from the air. The subsequent mixture is ignited with the resulting expansion of gases pushing the guide assembly and thus driving the fastener into the workpieces. This design is complicated and is far more expensive then a standard pneumatic fastener gun. Both electricity and fuel are required as the spark source derives its energy typically from batteries. The chambering of an explosive mixture of fuel, the use of consumable fuel cartridges, the loud report and the release of combustion products are all disadvantages of this solution. Systems such as these are already in existence and are sold commercially to contractors under the Paslode™ name.

Another commercially available solution is a fastener gun that uses electrical energy to drive a stapler or wire brad. Such units typically use a solenoid to drive the fastener (such as those commercially available under the Arrow™ name or those which use a ratcheting spring system such as the Ryobi™ electric stapler). These units are limited to short fasteners (typically 1" or less), are subject to high reactionary forces on the user and are limited in their repetition rate.

The high reactionary force is a consequence of the comparatively long time it takes to drive the fastener into the substrate. Additionally, because of the use of mechanical springs or solenoids, the ability to drive longer fasteners or larger fasteners is severely restricted, thus relegating these devices to a limited range of applications. A further disadvantage of the solenoid driven units is they often must be plugged into the wall in order to have enough voltage to create the force needed to drive even short fasteners.

A final commercially available solution is to use a flywheel mechanism and clutch the flywheel to an anvil that drives the fastener. Examples of such tools can be found under the Dewalt™ name. This tool is capable of driving the fasteners very quickly and in the longer sizes. The primary drawback to such a tool is the large weight and size as compared to the pneumatic counterpart. Additionally, the drive mechanism is very complicated, which gives a high retail cost in comparison to the pneumatic fastener gun.

Clearly based on the above efforts, a need exists to provide portable solution to driving fasteners which is unencumbered by fuel cells or air hoses. Additionally, the solution ought to provide a low reactionary feel, be able to drive full size fasteners and be simple, cost effective and robust in operation.

The prior art teaches several additional ways of driving a fastener or staple. The first technique is based on a multiple impact design. In this design, a motor or other power source is connected to an impact anvil through either a lost motion coupling or other device. This allows the power source to make multiple impacts on the fastener to drive it into the workpiece. The disadvantages in this design include increased operator fatigue since the actuation technique is a series of blows rather than a single drive motion. A further disadvantage is that this technique requires the use of an energy absorbing mechanism once the fastener is seated. This is needed to prevent the anvil from causing excessive damage to the substrate as it seats the fastener. Additionally, the multiple impact designs are not very efficient because of the constant motion reversal and the limited operator production speed.

A second design that is taught in U.S. Pat. Nos. 3,589,588, 5,503,319, and 3,172,121 includes the use of potential energy storage mechanisms (in the form of a mechanical spring). In these designs, the spring is cocked (or activated) through an electric motor. Once the spring is sufficiently compressed, the energy is released from the spring into the anvil (or fastener driving piece), thus pushing the fastener into the substrate. Several drawbacks exist to this design. These include the need for a complex system of compressing and controlling the spring, and in order to store sufficient energy, the spring must be very heavy and bulky. Additionally, the spring suffers from fatigue, which gives the tool a very short life. Finally, metal springs must move a significant amount of mass in order to decompress, and the result is that these low-speed fastener drivers result in a high reactionary force on the user.

To improve upon this design, an air spring has been used to replace the mechanical spring. U.S. Pat. No. 4,215,808 teaches of compressing air within a guide assembly and then releasing the compressed air by use of a gear drive. This patent overcomes some of the problems associated with the mechanical spring driven fasteners described above, but is subject to other limitations. One particular troublesome issue with this design is the safety hazard in the event that the anvil jams on the downward stroke. If the fastener jams or buckles within the feeder and the operator tries to clear the jam, he is subject to the full force of the anvil, since the anvil is predisposed to the down position in all of these types of devices. A further disadvantage presented is that the fastener must be fed once the anvil clears the fastener on the backward stroke. The amount of time to feed the fastener is limited and can result in jams and poor operation, especially with longer fasteners. A further disadvantage to the air spring results from the need to have the ratcheting mechanism as part of the anvil drive. This mechanism adds weight and causes significant problems in controlling the fastener drive since the weight must be stopped at the end of the stroke. This added mass slows the fastener drive stroke and increases the reactionary force on the operator. Additionally, because significant kinetic energy is contained within the air spring and piston assembly the unit suffers from poor efficiency. This design is further subject to a complicated drive system for coupling and uncoupling the air spring and ratchet from the drive train which increases the production cost and reduces the system reliability.

U.S. Pat. No. 5,720,423 again teaches of an air spring that is compressed and then released to drive the fastener. The drive or compression mechanism used in this device is limited in stroke and thus is limited in the amount of energy which can be stored into the air stream. In order to provide sufficient energy in the air stream to achieve good performance, this patent teaches use of a gas supply which preloads the guide assembly at a pressure higher than atmospheric pressure. Furthermore, the compression mechanism is bulky and complicated. In addition, the timing of the motor is complicated by the small amount of time between the release of the piston and anvil assembly from the drive mechanism and its subsequent re-engagement. Additionally. U.S. Pat. No. 5,720,423 teaches that the anvil begins in the retracted position, which further complicates and increases the size of the drive mechanism. Furthermore, because of the method of activation, these types of mechanisms as described in U.S. Pat. Nos. 5,720,423 and 4,215,808 must compress the air to full energy and then release off the tip of the gear while under full load. This method of compression and release causes severe mechanism wear. As will be discussed below, the present disclosure overcomes these and other limitations in the prior art use of air springs.

A third means for driving a fastener that is taught includes the use of flywheels as energy storage means. The flywheels are used to a hammering anvil that impacts the fastener. This design is described in detail in U.S. Pat. Nos. 4,042,036, 5,511,715, and 5,320,270. One major drawback to this design is the problem of coupling the flywheel to the driving anvil. This prior art teaches the use of a friction clutching mechanism that is both complicated, heavy and subject to wear. Further limiting this approach is the difficulty in controlling the energy in the fastener system. The mechanism requires enough energy to drive the fastener, but retains significant energy in the flywheel after the drive is complete. This further increases the design complexity and size of such prior art devices.

A fourth means for driving a fastener is taught in the present inventors' U.S. Pat. No. 8,079,504, which uses a compression on demand system with a magnetic detent. This system overcomes many of the advantages of the previous systems but still has its own set of disadvantages which include the need to retain a very high pressure for a short period of time. This pressure and subsequent force necessitate the use of high strength components and more expensive batteries and motors.

A fifth means is taught in pending U.S. patent application Ser. No. 13/922,465, which uses a vacuum to drive a fastener drive assembly. This clearly has its own advantages over the previous systems but has its own set of disadvantages, including the need to retain a seal against air pressure. This sealing requirement necessitates the use of more accurate cylinders and pistons, thus contributing to the manufacturing cost.

All of the currently available devices suffer from one or more the following disadvantages:

- Complex, expensive and unreliable designs. Fuel powered mechanisms such as Paslode™ achieve portability but require consumable fuels and are expensive. Rotating flywheel designs such as Dewalt™ have complicated coupling or clutching mechanisms based on frictional means. This adds to their expense.
- Poor ergonomics. The fuel powered mechanisms have loud combustion reports and combustion fumes. The multiple impact devices are fatiguing and are noisy.
- Non-portability. Traditional fastener guns are tethered to a fixed compressor and thus must maintain a separate supply line.
- High reaction force and short life. Mechanical spring driven mechanisms have high tool reaction forces because of their long fastener drive times. Additionally, the springs are not rated for these types of duty cycles leading to premature failure. Furthermore, consumers are unhappy with their inability seat longer fasteners or work with denser wood species.
- Safety issues. The prior art "air spring" and heavy spring driven designs suffer from safety issues for longer fasteners since the predisposition of the anvil is towards the substrate. During jam clearing, this can cause the anvil to strike the operators hand.
- The return mechanisms in most of these devices involve taking some of the drive energy. Either there is a bungee or spring return of the driving anvil assembly or there is a vacuum or air pressure spring formed during the movement of the anvil. All of these mechanisms take energy away from the drive stroke and decrease efficiency.

In light of these various disadvantages, there exists the need for a fastener driving apparatus that overcomes these various disadvantages of the prior art, while still retaining the benefits of the prior art.

SUMMARY OF THE INVENTION

In accordance with the present invention, a fastener driving apparatus is described which derives its power from an electrical source, preferably rechargeable batteries, and uses a motor to actuate a spring (such as a gas spring, for example). After sufficient movement of a piston in the gas spring, the piston of the gas spring commences movement, accelerating an anvil and/or anvil assembly. The anvil assembly preferably has a mass that is greater than the weight of the piston, the contact of the piston with the anvil causes the anvil to move. In an embodiment, the piston comes to rest on a bumper but the anvil assembly continues to move toward and into contact with a fastener such that the anvil drives the fastener. The effective mass differential between the piston and the anvil facilitates sufficient energy being transferred to the anvil for driving a fastener. A return spring or other return mechanism is incorporated to return the anvil, after the anvil drives the fastener, to a position where the anvil and/or anvil assembly may again be operatively contacted by the piston for another drive by the anvil.

By using a gas spring and with a stroke differential between the piston and the anvil, the present fastener driving assembly is able to generate sufficient energy to drive a fastener with only a small increase in pressure in the chamber or other environment in which the piston is disposed. This unexpectedly increased the efficiency of the unit since heat of compression of a gas is a significant source of energy inefficiency. (This aspect also reduced the size of the apparatus as the stroke of the piston is significantly less than the stroke of the anvil and anvil assembly. During the inventive process, it was also discovered that the mass differential greatly impacts the efficiency of the device. Ideally, the moving mass within the gas spring (primarily the piston) is less than the moving (or eventually thrown) mass of the anvil and anvil assembly. Another unexpected result was the high efficiency of the apparatus as compared to the inventor's vacuum-actuated fastener driver patent (U.S. Pat. No. 8,079,504) as seal friction loss is a major source of efficiency reduction. By limiting the stroke of the gas spring in relation to the stroke of the anvil and anvil assembly, the length over which the seal frictional loss occurs was significantly reduced. This was a major unexpected benefit of the present disclosure, dramatically increasing the efficiency over the prior art. For instance, test results show conversion efficiencies (potential energy to kinetic energy in the drive anvil) of over 80%, which is far better than the 65% obtained by the apparatus of the '504 patent.

The fastener driving cycle of the apparatus disclosed herein may start with an electrical signal, after which a circuit connects a motor to the electrical power source. The motor is coupled to the gas spring through a drive mechanism. In an operational cycle of the drive mechanism, the mechanism alternatively (1) actuates the piston of the gas spring and (2) decouples from the piston. For example, during a portion of its cycle, the drive mechanism may move the piston to increase potential energy stored within the gas spring. In the next step of the cycle, the mechanism decouples from the piston to allow the accumulated potential energy within the gas spring to act on and actuate the piston. The piston thereupon moves and causes the anvil assembly to move and drive a fastener. A spring or other return mechanism is operatively coupled to the anvil and anvil assembly to return the anvil to an initial position. In an embodiment, at least one bumper is disposed within the gas spring or outside the gas spring to reduce the wear on the piston. In an embodiment another bumper is used to reduce the wear on the anvil assembly that otherwise may occur in operation of the fastener driving apparatus.

In an embodiment, the mass of the anvil and anvil assembly is at least equal to the moving mass of the gas spring, and more preferably, at least 1.2 times the moving mass of the gas spring.

In an embodiment, the stroke or movement of the piston is less than one half the total movement of the anvil and anvil assembly. Further preferred is that the movement of the piston results in a volume decrease within the gas spring of less than 20% of the initial volume (which thus reduces losses from heat of compression.)

In an embodiment, a sensor and a control circuit are provided for determining at least one position of the anvil, anvil assembly, and/or drive mechanism to enable the proper timing for stopping the operational cycle of the apparatus. Further, this information can be used to detect a jam condition for proper recovery.

In an embodiment, the piston launches the anvil and/or anvil assembly prior to or within less than 20% of the total fastener stroke. This results in an improved safety profile in the event of a jam, as the anvil and anvil assembly will have dissipated its kinetic energy, thus allowing the user to fix the jam without having potential energy remaining in the anvil and anvil assembly.

Accordingly, and in addition to the objects and advantages of the portable electric fastener gun as described above, several objects and advantages of the present invention are:

- To provide a simple design for driving fasteners that has a significantly lower production cost than currently available nail guns and that is portable and does not require an air compressor.
- To provide a fastener driving device that mimics the pneumatic fastener performance without a tethered air compressor.
- To provide an electrical driven high power fastening device that has very little wear.
- To provide an electric motor driven fastener driving device in which energy is not stored behind the fastener driving anvil, thus greatly enhancing tool safety.
- To provide a more energy efficient mechanism for driving nails than is presently achievable with a compressed air design.

These together with other aspects of the present disclosure, along with the various features of novelty that characterize the present disclosure, are pointed out with particularity in the claims annexed hereto and form a part of the present disclosure. For a better understanding of the present disclosure, its operating advantages, and the specific objects attained by its uses, reference should be made to the accompanying drawings and detailed description in which there are illustrated and described exemplary embodiments of the present disclosure.

DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DISCLOSURE

The best mode for carrying out the present disclosure is presented in terms of its preferred embodiment, herein depicted in the accompanying figures. The preferred embodiments described herein detail for illustrative purposes are subject to many variations. It is understood that various omissions and substitutions of equivalents are contemplated as circumstances may suggest or render expedient, but are intended to cover the application or implementation without departing from the spirit or scope of the present disclosure. Furthermore, although the following relates substantially to one embodiment of the design, it will be understood by those familiar with the art that changes to materials, part descriptions and geometries can be made without departing from the spirit of the invention. It is further understood that references such as front, back or top dead center, bottom dead center do not refer to exact positions but approximate positions as understood in the context of the geometry in the attached figures.

The terms "a" and "an" herein do not denote a limitation of quantity, but rather denote the presence of at least one of the referenced items.

Figure 4:
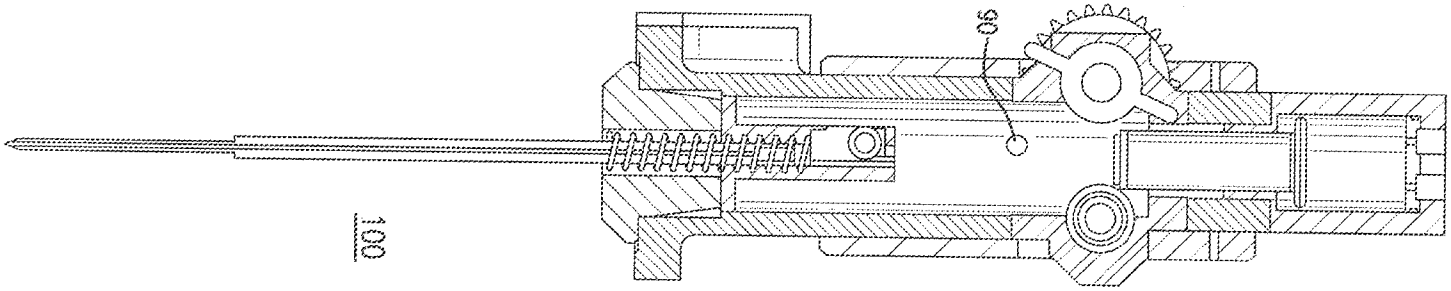
FIG. 4 shows a cutaway view of a fastener driving apparatus, in accordance with an exemplary embodiment of the present disclosure wherein the anvil assembly has separated from the gas spring and is driving the fastener.
Figure 5:
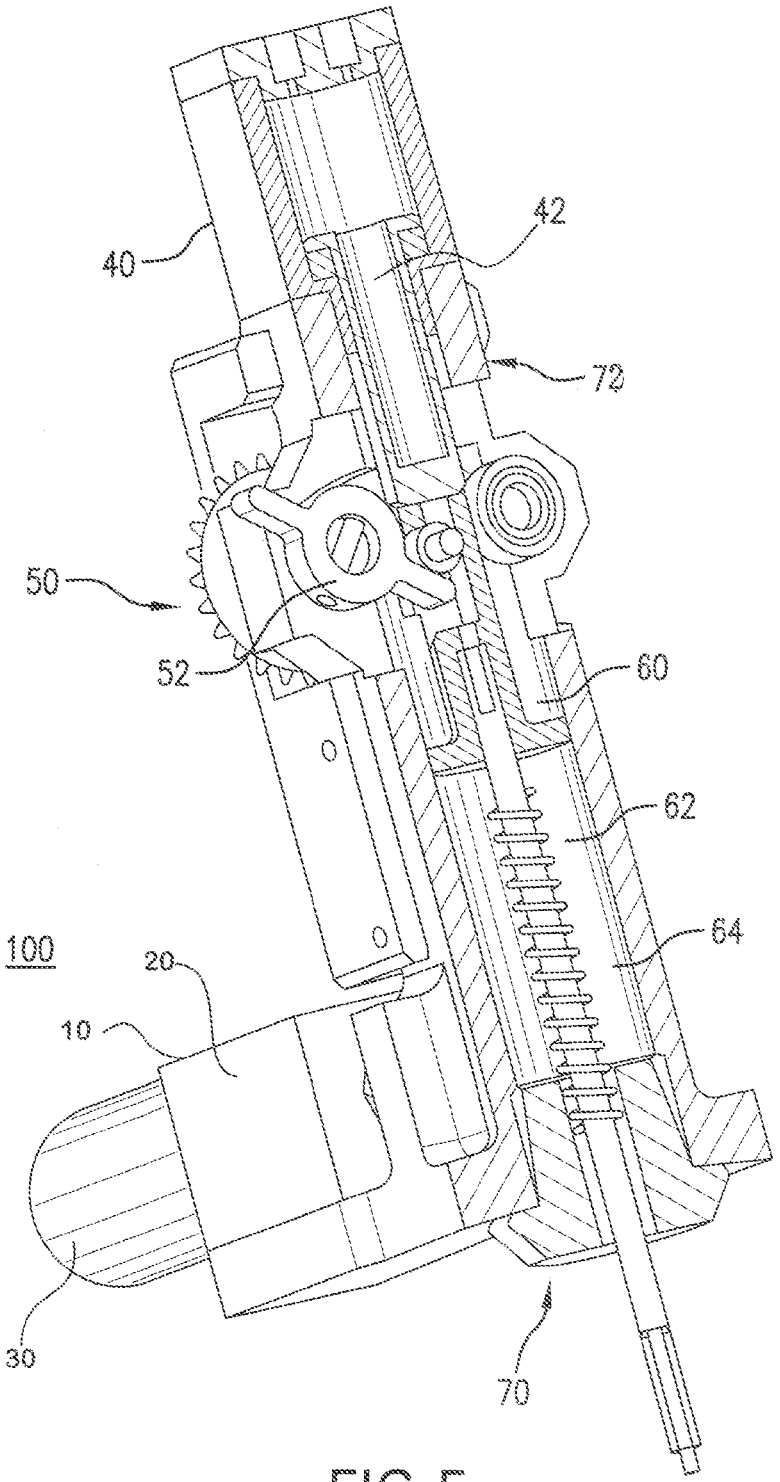
FIG. 5 shows a cutaway view of a fastener driving apparatus, in accordance with an exemplary embodiment of the present disclosure wherein the gas spring has returned to a starting position.
Figure 6:
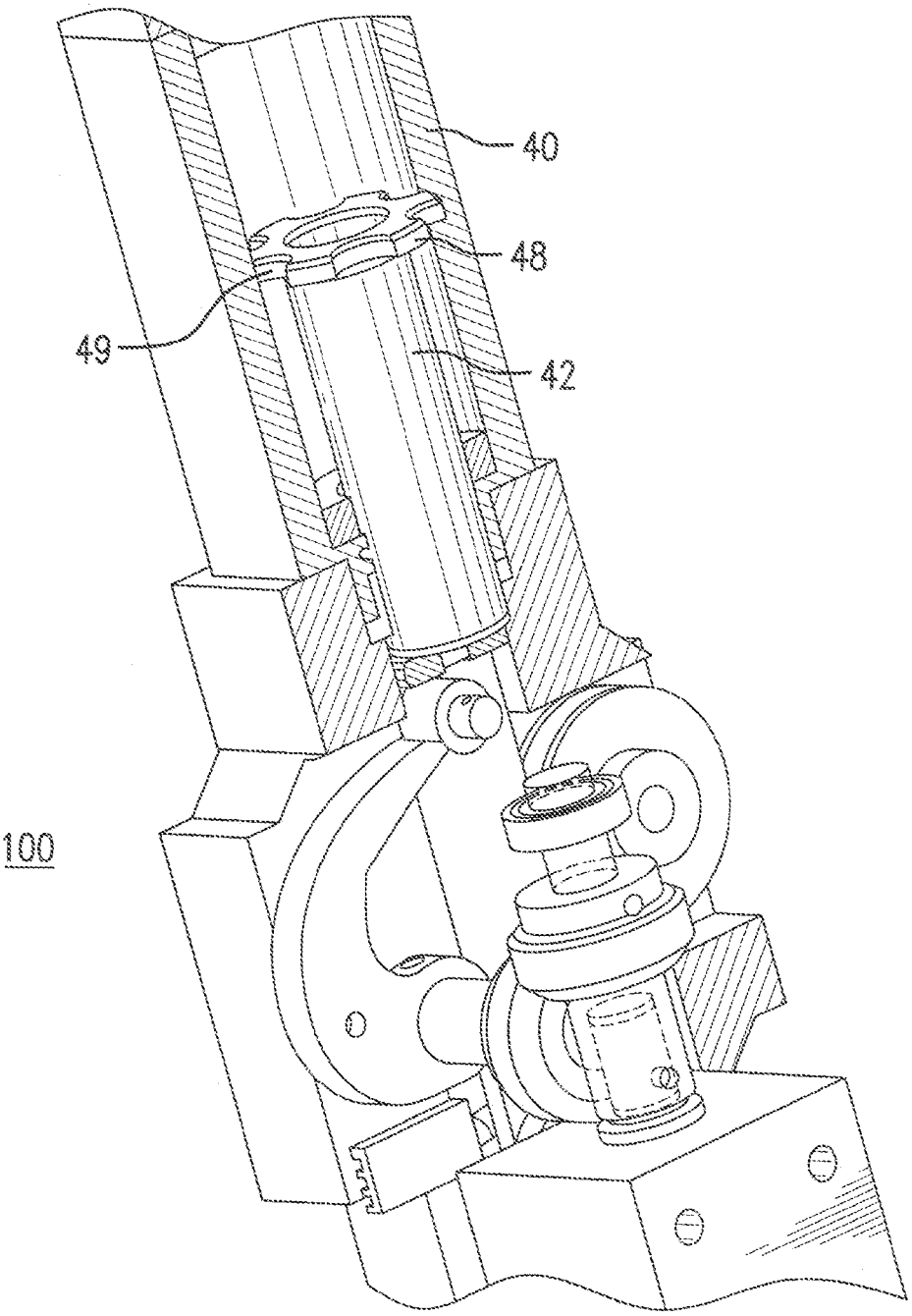
FIG. 6 shows a piston flange of a fastener driving apparatus, in accordance with an exemplary embodiment of the present disclosure.

Referring now to FIGS. 1-6, the present disclosure provides for a fastener driving apparatus 100. In an embodiment, the apparatus 100 comprises a power source 10, a control circuit 20, a motor 30, a gas spring 40, a drive mechanism 50, an anvil assembly 60, and an anvil 62. The apparatus 100 may further comprise an anvil return mechanism 64 and at least one bumper 70. The gas spring 40 includes a piston 42, which piston 42 is at least partially disposed within a sealed chamber 44, and which piston 42 is selectively actuated by the drive mechanism 50. A bumper 72 is preferably disposed within the gas spring 40 to absorb a portion of the force of impact of the piston 42. The gas spring 40 further comprises a nose portion 46 (which nose portion may be a part of or coupled to the piston) and which nose portion 46 extends out of the chamber and which makes operative contact with the anvil 62 and/or anvil assembly 60 during a portion of the operational cycle of the apparatus 100. The piston 42 also comprises a flange 48 that is at or near the end of the piston that is distal to the anvil and anvil assembly, which flange 48 retains the piston 42 within the gas spring 40. The flange extends away from and beyond the circumference of the piston and may also impact the bumper 72 to absorb the energy of the gas spring during a portion of the stroke. Referring to FIG. 6, an exemplary configuration of the flange is shown, wherein portions of said flange are immediately adjacent to the interior surface of the gas spring, and other portions of said flange are disposed away from the interior of the gas spring. The flange 48 further comprises an opening or open area 49 to allow air or gas to flow from one side of the piston or piston flange to another side of the piston or piston flange. In an embodiment, the area of the opening or open area is least 5% of the area of the cross-sectional area of the interior of the gas piston.

Figure 1:
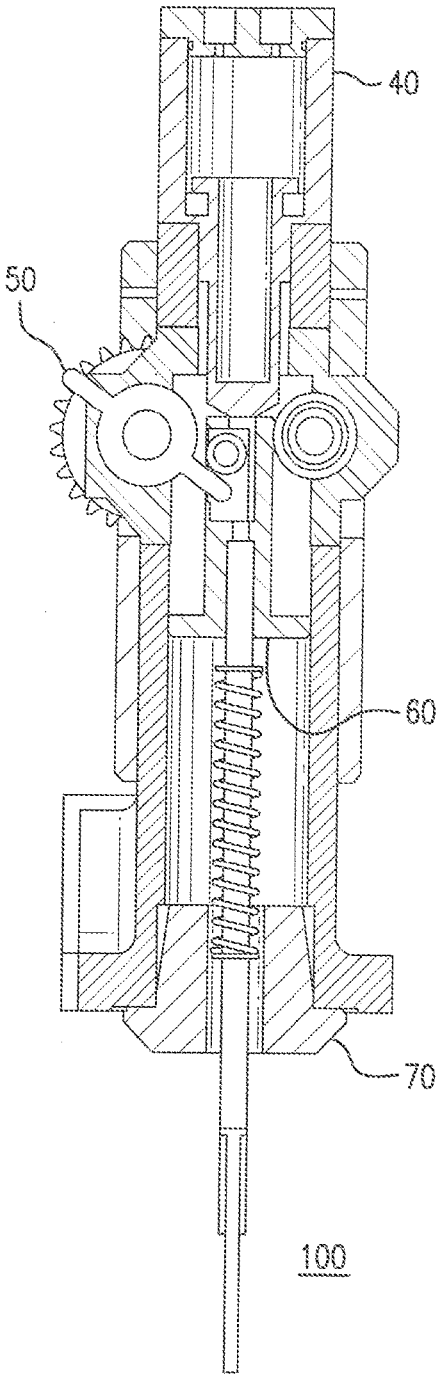
FIG. 1 shows a cutaway view of a fastener driving apparatus, in accordance with an exemplary embodiment of the present disclosure.
Figure 2:
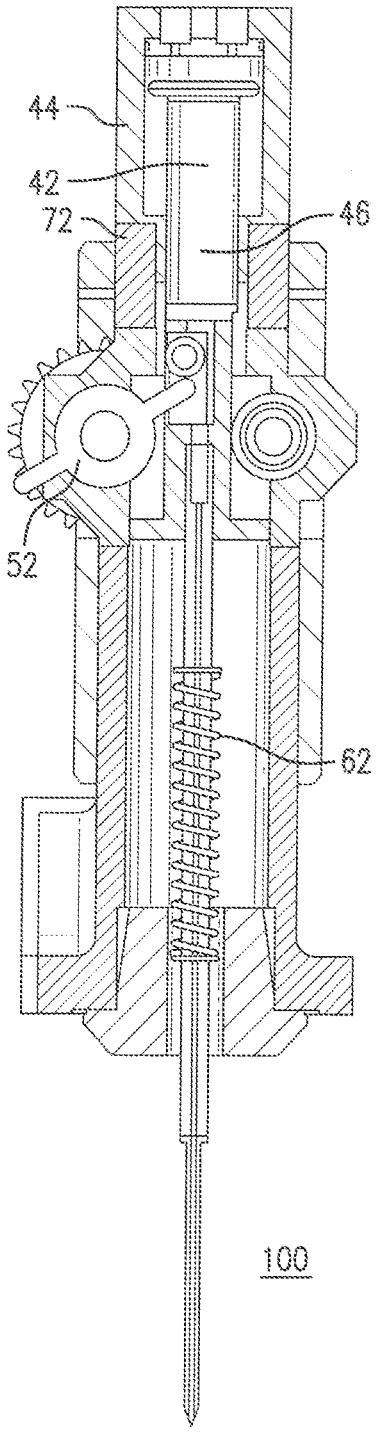
FIG. 2 shows a cutaway view of a fastener driving apparatus, in accordance with an exemplary embodiment of the present disclosure wherein the gas spring is being compressed.
Figure 3:
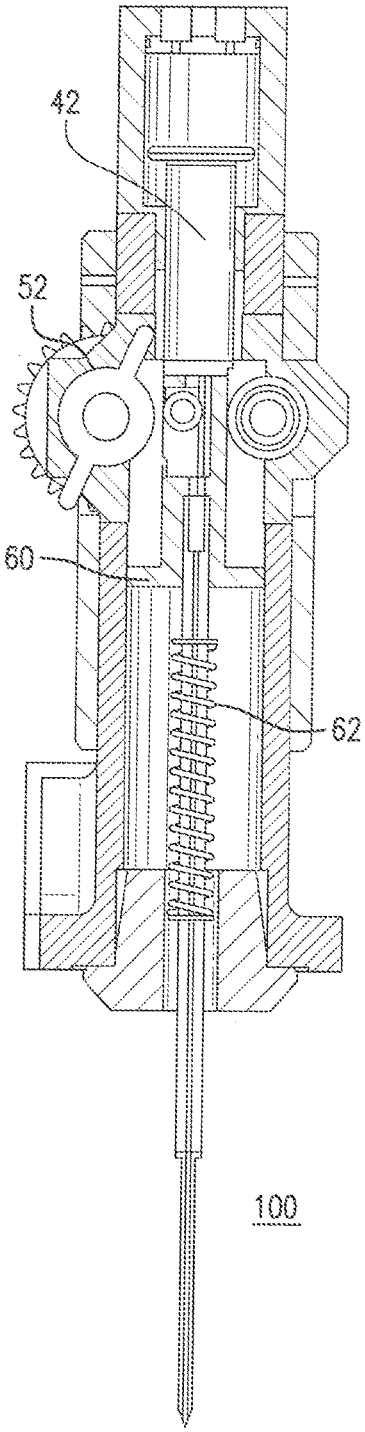
FIG. 3 shows a cutaway view of a fastener driving apparatus, in accordance with an exemplary embodiment of the present disclosure wherein the gas spring is releasing the drive anvil.

The drive mechanism 50 may comprise, in an embodiment, a rack gear with intervals of teeth and no teeth. The drive mechanism 50 preferably comprises a cam-driven mechanism 52 as illustrated in the figures. In another embodiment, the drive mechanism 50 may comprise an interrupted friction wheel. It will be apparent that the drive mechanism 50 is configured to permit transition from engagement with the gas spring 40 to disengagement from the gas spring 40. The drive mechanism 50 is operatively coupled to the gas spring 40, and in an particular embodiment, to the piston 42 such that the drive mechanism 50 may alternate in actuating the piston 42 (when the gear teeth or cam is engaged, for example, and as shown in FIGS. 1 and 2) and in refraining from applying a drive force on the piston (as shown in FIGS. 3 and 4). In another embodiment, the drive mechanism 50 preferably acts directly upon the anvil assembly 60, which anvil assembly 60 is at least operatively coupled to and moves the piston 42 to store potential energy (as described elsewhere herein.)

In an embodiment, and as shown in FIG. 2, the drive mechanism 50 engages and actuates the piston 42 (and/or anvil assembly 60) to store potential energy within the gas spring 40, which actuation of the piston 42 may be referred to as an "energized position" of the piston 42. In an embodiment, the initial pressure (before the drive mechanism 50 actuates the piston 42) within the gas spring 40 is at least 40 psi (absolute). In another embodiment, the initial pressure within the gas spring 40 is at least 200 psi. The configuration and design of the gas spring 40 are such that the pressure increase during the piston movement is less than 30% of the initial pressure, and in an embodiment, less than 50% of the initial pressure, which allows the drive mechanism 50 to operate at a more constant torque, thus improving the motor efficiency. As shown in FIG. 3, the drive mechanism 50 thereafter disengages the piston 42 (and/or anvil assembly 60), allowing potential energy to act on the piston 42 and cause the piston 42 to move and act on the anvil 62 and/or anvil assembly 60 (as will be described in further detail below). The drive mechanism 50 is timed and/or configured to prevent further engagement with the gas spring 40 (and/or anvil assembly 60) until after the anvil 62 and/or anvil assembly 60 has returned to an approximate starting position. As shown in FIG. 5, the drive mechanism 50 may thereafter again act on the piston 42 (and/or anvil assembly 60) to again store potential energy within the gas spring 40 and may thereafter again temporarily cease to act on the piston 42 (and/or anvil assembly 60) to allow potential energy to instead act on the piston 42. In an embodiment, the stroke of the piston 42 is less than stroke of the anvil assembly 60.

The anvil 62 and/or anvil assembly 60 is operatively coupled to the gas spring 40, such as to the piston 42 or nose portion such that when the piston 42 is released under pressure from the drive mechanism 50, the force from the piston 42 is imparted onto the anvil 62, causing the anvil 62 and/or anvil assembly to move in a direction and, as shown in FIG. 4 to release (or be launched) away from the piston 42 and drive a fastener, for example. It was discovered in the course of developing the disclosure that the ratio of the thrown mass to the moving mass within the gas spring 40 (primarily the piston 42) was exceedingly important to the efficiency of the fastener driving apparatus 100. It is preferred to have thrown mass (which in this case is the anvil assembly 60) that is greater than 50% of the total moving mass (anvil assembly mass+gas spring moving mass) and even more preferable to have the anvil assembly mass at least 60% of the total moving mass. This discovery allows the present disclosure to have increased efficiency in transferring the potential energy into driving energy on the fastener. In an embodiment, the mass of the anvil 62 is at least two times the mass of the piston 42. In an embodiment, the piston 42 has a mass of 90 grams and the anvil 62 has a mass of 250 grams. In an embodiment, the piston 42 is hollowed out to lighten its mass and further may be constructed of lightweight materials such as hard anodized aluminum, plastics or the like. The anvil 62 may be operatively coupled to a guide, shaft, or other structure that limits and guides the range of motion of the anvil 62.

Referring further to FIG. 4, a sensor 90 is provided for determining at least one position of the anvil, anvil assembly, and/or drive mechanism to enable the proper timing for stopping the operational cycle of the apparatus. Further, this information can be used to detect a jam condition for proper recovery.

At least one bumper 70 may be disposed on the apparatus 100 for absorbing a portion of the force of impact of the piston 42 within the gas spring 40 or of the anvil 62 and/or anvil assembly 60, to reduce wear and tear on the components of the apparatus 100. The at least one bumper 70 may be of an elastic material, and may be disposed on the apparatus 100 at any position where it is capable of absorbing a portion of the force of impact by the piston 42 or the anvil 62.

The anvil 62 further comprises a return mechanism 64 to enable to the anvil 62 to return to a position where it can be again contacted or acted on by the gas spring 40. In an embodiment, the return mechanism 64 is a return spring that is disposed on or in the guide or shaft that constrains the anvil 62, which return spring would be disposed nearer the end or portion of the anvil 62 that is distal to the gas spring 40. After the gas spring 50 causes the anvil 62 to move, and after or in connection with the anvil 62 impacting and driving a fastener, the return mechanism 64 imparts a force on the anvil 62 to cause the anvil 62 to return to a position where it may again be operatively acted upon by the gas spring 40. In the embodiment where the return mechanism 64 is a return spring, the return spring may be disposed with respect to the anvil 62 such that motion of the anvil 62 toward a fastener to be driven also causes the spring to compress, and after the anvil 62 has reached the end of its drive stroke, the compressed return spring decompresses to actuate the anvil 62 to the anvil's earlier or original position.

In another embodiment, the fastener driving apparatus 100 disclosed herein comprises a spring in place of the gas spring and piston. In this embodiment, the spring may comprise a mechanical spring, a gas spring, an elastomer spring or an elastomer, for example. The apparatus further comprises a drive mechanism, an anvil assembly, an anvil, an anvil return mechanism, and at least one bumper. Similar to the embodiment described above, the drive mechanism may comprise, in an embodiment, a rack gear with intervals of teeth and no teeth. The drive mechanism preferably comprises a cam-driven mechanism as illustrated in the figures. It will be apparent that the drive mechanism is configured to permit transition from engagement with the spring to disengagement from the spring. The drive mechanism is operatively coupled to the spring such that the drive mechanism may alternate in actuating the spring (when the gear teeth or cam is engaged, for example) and in refraining from applying a drive force on the such that other forces are able to act on and actuate the spring. In another embodiment, the drive mechanism preferably acts directly upon the anvil assembly, which anvil assembly is at least operatively coupled to the spring and moves the spring to store potential energy (as described elsewhere herein.)

In an embodiment, the drive mechanism engages and actuates the spring (and/or anvil assembly) to store potential energy within the spring, which actuation of the spring may be referred to as an "energized position" of the spring. The drive mechanism thereafter disengages the spring (and/or anvil assembly), allowing potential energy to act on the spring and cause the spring to move and act on the anvil and/or anvil assembly (as will be described in further detail below). The drive mechanism is timed and/or configured to prevent further engagement with the spring (and/or anvil assembly) until after the anvil and/or anvil assembly has returned to an approximate starting position. The drive mechanism may thereafter again act on the spring (and/or anvil assembly) to again store potential energy within the spring and may thereafter again temporarily cease to act on the spring (and/or anvil assembly) to allow potential energy to instead act on the spring. In an embodiment, the stroke of the spring is less than stroke of the anvil assembly.

Similar to the gas spring embodiment described previously, the anvil and/or anvil assembly is operatively coupled to the spring, such that when the spring is released from the drive mechanism the force from the spring is imparted onto the anvil and/or anvil assembly, causing the anvil and/or anvil assembly to move in a direction and to release (or be launched) away from the spring and drive a fastener, for example. It is preferred to have thrown mass (which in this case is the anvil assembly) that is greater than 50% of the total moving mass (anvil assembly mass+spring moving mass) and even more preferable to have the anvil assembly mass at least 60% of the total moving mass. In an embodiment, the mass of the anvil is at least two times the mass of the spring. In an embodiment, the spring has a mass of 90 grams and the anvil has a mass of 250 grams. The anvil may be operatively coupled to a guide, shaft, or other structure that limits and guides the range of motion of the anvil.

At least one bumper may be disposed on the apparatus for absorbing a portion of the force of impact of the spring, to reduce wear and tear on the components of the apparatus. The at least one bumper may be of an elastic material, and may be disposed on the apparatus at any position where it is capable of absorbing a portion of the force of impact by the spring.

The anvil further comprises a return mechanism to enable to the anvil to return to a position where it can be again contacted or acted on by the spring. In an embodiment, the return mechanism is a return spring that is disposed on or in the guide or shaft that constrains the anvil, which return spring would be disposed nearer the end or portion of the anvil that is distal to the spring that causes the anvil to drive a fastener. After the spring causes the anvil to move to drive a fastener, and after or in connection with the anvil impacting and driving a fastener, the return mechanism imparts a force on the anvil to cause the anvil to return to a position where it may again be operatively acted upon by the spring. In the embodiment where the return mechanism is a return spring, the return spring may be disposed with respect to the anvil such that motion of the anvil toward a fastener to be driven also causes the return spring to compress, and after the anvil has reached the end of its drive stroke, the compressed return spring decompresses to actuate the anvil to the anvil's earlier or original position.

The present disclosure offers the following advantages: the gas spring, mechanical spring and elastomer are capable of generating a relatively high amount of force in a small amount of space such that the size of the apparatus may be smaller than other fastener drivers. Further, because of the relatively small increase from the initial pressure in the gas spring to the maximum pressure, the motor of the apparatus is not significantly overworked or over torqued, thus leading to a longer useful life of the apparatus. Furthermore, it was unexpectedly discovered that this invention has an improved safety profile. For example, if a nail becomes jammed, the potential energy of the air spring does not act directly on the fastener and thus while the user removes the fastener, there is reduced potential for injury. It was a further unexpected discovery of the present disclosure that the apparatus has an improved recoil force as opposed to conventional and or the inventor's prior fastener inventions. This was a totally unexpected discovery as the anvil/anvil assembly is a free traveling mass and as such during the course of the driving of the fastener does not put a reactionary force on the operator. In contrast and in prior art tools, air pressure on the piston and anvil assembly acts during the entire drive and at the end of the stroke can result in significant recoil to the operator.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the disclosure and various embodiments with various modifications as are suited to the particular use contemplated.

What is claimed is:

1. A fastener driving apparatus, the apparatus comprising
a power source,
a control circuit,
a motor,
a gas spring, said gas spring comprising a chamber and a piston disposed within said chamber,
a drive mechanism capable of selectively engaging and disengaging said gas spring, said gas spring capable of moving to an energized position, upon being engaged by said drive mechanism,
and an anvil assembly, said anvil assembly comprising an anvil,
wherein said drive mechanism selectively engages said gas spring to apply a force on said gas spring to move said piston of said gas spring and thereafter disengages from and ceases applying a force on said gas spring,
wherein when said drive mechanism engages said gas spring, potential energy is stored by said movement, and after said drive mechanism thereafter disengages said gas spring, said gas spring releases its potential energy and accelerates at least one of said anvil and said anvil assembly, at least one of said accelerated anvil and said accelerated anvil assembly then separating from said gas spring for a portion of the stroke to drive a fastener.

2. The fastener driving apparatus of claim 1, wherein the total stroke of said gas spring piston is no more than 70% of the total stroke of at least one of said anvil and said anvil assembly.

3. The fastener driving apparatus of claim 1, wherein the pressure change within the gas spring caused by movement of said gas spring piston is less than 50%.

4. The fastener driving apparatus of claim 1, wherein said control circuit further comprises at least one sensor, wherein said at least one sensor may determine at least one of the position of said anvil, the position of said anvil assembly, and the position of said drive mechanism.

5. The fastener driving apparatus of claim 1, wherein said drive mechanism comprises one of an interrupted friction wheel, a rack-and-pinion arrangement, and a cam.

6. The fastener driving apparatus of claim 1, wherein the moving mass within said gas spring is less than 80% of the moving mass of at least one of said anvil and said anvil assembly.

7. The fastener driving apparatus of claim 1, said apparatus further comprising at least one bumper for absorbing the impact of the gas spring moving mass.

8. The fastener driving apparatus of claim 1, wherein said anvil assembly further comprises a return mechanism for biasing said anvil to a position where said gas spring is proximate to said anvil.

9. The fastener driving apparatus of claim 1, wherein said gas spring further comprises a flange for retaining said piston of said gas spring, and said flange comprising an opening, wherein the area of said opening of said flange is at least 5% of the internal cross-sectional area of said gas spring.

10. A fastener driving apparatus, the apparatus comprising
a power source,
a control circuit,
a motor,
a gas spring, said gas spring comprising a chamber and a piston disposed within said chamber,
a drive mechanism capable of selectively engaging and disengaging said gas spring, said gas spring capable of moving to an energized position, upon being engaged by said drive mechanism,
and an anvil assembly, said anvil assembly comprising an anvil,
wherein said drive mechanism comprises an engagement region for engaging and causing said gas spring to move said piston of said gas spring chamber and a non-engagement region for cause said drive mechanism to cease causing said gas spring to so move,
wherein potential energy is stored by said movement of said piston, and after said drive mechanism thereafter disengages said gas spring, said gas spring accelerates at least one of said anvil and said anvil assembly, at least one of said accelerated anvil and said accelerated anvil assembly then separating from said gas spring to drive a fastener.

11. The fastener driving apparatus of claim 10, wherein the total stroke of said gas spring piston is no more than 70% of the total stroke of at least one of said anvil and said anvil assembly.

12. The fastener driving apparatus of claim 10, wherein the pressure change within the gas spring caused by movement of said gas spring piston is less than 50%.

13. The fastener driving apparatus of claim 10, wherein said control circuit further comprises at least one sensor, wherein said at least one sensor may determine at least one of the position of said anvil, the position of said anvil assembly, and the position of said drive mechanism.

14. The fastener driving apparatus of claim 10, wherein the moving mass within said gas spring is less than 80% of the moving mass of at least one of said anvil and said anvil assembly.

15. The fastener driving apparatus of claim 10, said apparatus further comprising at least one bumper for absorbing the impact of the gas spring moving mass.

16. The fastener driving apparatus of claim 10, wherein the pressure within the gas spring before the drive mechanism engages the gas spring is at least 200 psi.

17. A fastener driving apparatus, the apparatus comprising
a power source,
a control circuit,
a motor,
a spring,
a drive mechanism capable of selectively engaging and disengaging said spring, said spring capable of moving to an energized position, upon being engaged by said drive mechanism,
and an anvil assembly, said anvil assembly comprising an anvil, wherein said drive mechanism selectively engages said spring to apply a force on said spring to move said piston of said spring and thereafter disengages from and ceases applying a force on said spring, wherein when said drive mechanism engages said spring, potential energy is stored by said movement, and after said drive mechanism thereafter disengages said spring, said spring releases its potential energy and accelerates said anvil, said anvil then separating from said spring for a portion of the stroke to drive a fastener.

18. The fastener driving apparatus of claim 17, wherein said spring is one of a mechanical spring, a metal spring, a gas spring, an elastomer spring, and an elastomer.

19. The fastener driving apparatus of claim 17, wherein the total stroke of said spring is no more than 50% of the total stroke of at least one of said anvil and said anvil assembly.

20. The fastener driving apparatus of claim 16, said apparatus further comprising at least one bumper for absorbing the impact of the spring moving mass.

* * * * *